US011092149B2

(12) United States Patent
Jeon

(10) Patent No.: US 11,092,149 B2
(45) Date of Patent: Aug. 17, 2021

(54) DUAL DIAPHRAGM PUMP HAVING A PRESSURE PULSATION PAD

(71) Applicant: FOURL DESIGN CO. LTD., Gyeonggi-do (KR)

(72) Inventor: Suk Ho Jeon, Gyeonggi-do (KR)

(73) Assignee: FOURL DESIGN CO. LTD., Gyeonggi-do (KR)

( * ) Notice: Subject to any disclaimer, the term of this patent is extended or adjusted under 35 U.S.C. 154(b) by 155 days.

(21) Appl. No.: 15/749,894

(22) PCT Filed: Aug. 26, 2016

(86) PCT No.: PCT/KR2016/009503

§ 371 (c)(1),
(2) Date: Feb. 2, 2018

(87) PCT Pub. No.: WO2017/034365

PCT Pub. Date: Mar. 2, 2017

(65) Prior Publication Data

US 2018/0223826 A1 Aug. 9, 2018

(30) Foreign Application Priority Data

Aug. 27, 2015 (KR) ..... 10-2015-0121096

(51) Int. Cl.
*F04B 43/04* (2006.01)
*F04B 43/00* (2006.01)
(Continued)

(52) U.S. Cl.
CPC ..... *F04B 43/026* (2013.01); *F04B 43/00* (2013.01); *F04B 43/04* (2013.01); *F04B 43/14* (2013.01);
(Continued)

(58) Field of Classification Search
CPC ..... F04B 43/026; F04B 45/04; F04B 45/10; F04B 43/14; F04B 43/00; F04B 53/001;
(Continued)

(56) References Cited

U.S. PATENT DOCUMENTS 3,008,427 A * 11/1961 Foster et al. ..... F04B 43/02 417/542
5,551,843 A 9/1996 Hauser
(Continued)

FOREIGN PATENT DOCUMENTS

CN 2680360 Y 2/2005
CN 204511831 U 7/2015
(Continued)

OTHER PUBLICATIONS

Japan Patent Office, 1st Office Action of corresponding JP Patent Application No. 2018-510065, dated Jan. 23, 2019.
(Continued)

*Primary Examiner* — Bryan M Lettman
*Assistant Examiner* — Timothy P Solak
(74) *Attorney, Agent, or Firm* — IP Legal Services, LLC

(57) ABSTRACT

A dual pumping fluid pump which significantly reduces vibration and noise generation. When a cam installed on a rotating shaft of a single electric motor is rotated, a pair of first and second diaphragms installed in connection to an eccentric shaft portion formed on both the left and right sides of the cam alternatingly rise and descend in opposite directions and cause first and second intake check valves and first and second discharge check valves provided on a fluid passage box integrally and connectedly installed on the top surface of a pump housing to open or close first and second intake holes and first and second discharge holes to admit fluid through a fluid inlet and simultaneously discharge fluid through a fluid outlet, so that the simultaneous effects of the
(Continued)

intake pressure and discharge pressure of fluid causes pressure balancing to occur.

3 Claims, 7 Drawing Sheets

(51) Int. Cl.

| | |
|---|---|
| ***F04B 43/14*** | (2006.01) |
| ***F04B 45/047*** | (2006.01) |
| ***F04B 45/10*** | (2006.01) |
| ***F04B 43/02*** | (2006.01) |
| *F04B 45/04* | (2006.01) |
| *F04B 39/00* | (2006.01) |
| *F04B 53/00* | (2006.01) |

(52) U.S. Cl.
CPC ..... *F04B 45/047* (2013.01); *F04B 45/10* (2013.01); *F04B 39/0027* (2013.01); *F04B 39/0038* (2013.01); *F04B 43/02* (2013.01); *F04B 45/04* (2013.01); *F04B 53/001* (2013.01); *F04B 2201/0802* (2013.01); *F04B 2201/0804* (2013.01)

(58) Field of Classification Search
CPC ..... F04B 43/025; F04B 43/0009; F04B 39/0033; F04B 39/0038; F04B 39/005; F04B 2205/12; F04B 2205/13; F04B 2205/07; F04B 2201/0802; F04B 2201/0804
See application file for complete search history.

(56) References Cited

U.S. PATENT DOCUMENTS

| | | | | |
|---|---|---|---|---|
| 6,592,339 | B1 * | 7/2003 | Fukushima | F04B 9/047 417/269 |
| 2005/0196302 | A1 * | 9/2005 | Huang | F04B 45/043 417/412 |
| 2008/0260556 | A1 * | 10/2008 | Hoffman | F04B 35/04 417/423.1 |
| 2011/0282223 | A1 * | 11/2011 | Sano | A61B 5/02141 600/499 |
| 2014/0154117 | A1 * | 6/2014 | Fukami | F04B 43/026 417/413.1 |

FOREIGN PATENT DOCUMENTS

| | | | |
|---|---|---|---|
| JP | 51-013991 | U | 2/1976 |
| JP | 07-167061 | A | 7/1995 |
| JP | 2010-001749 | A | 1/2010 |
| JP | 2013-007340 | A | 1/2013 |
| KR | 20-0196593 | Y1 | 10/2000 |
| KR | 10-0291161 | B1 | 6/2001 |
| KR | 10-0856017 | B1 | 9/2008 |
| KR | 10-1182477 | B1 | 9/2012 |
| KR | 10-1332052 | B1 | 11/2013 |

OTHER PUBLICATIONS

Japan Patent Office, 2nd Office Action of corresponding JP Patent Application No. 2018-510065, dated Sep. 19, 2019.

* cited by examiner

- *Related Art* -

- *Related Art* -

- *Related Art* -

- *Related Art* -

- *Related Art* -

- *Related Art* -

DUAL DIAPHRAGM PUMP HAVING A PRESSURE PULSATION PAD

CROSS REFERENCE TO RELATED APPLICATIONS

This application is a National Stage Patent Application of PCT International Patent Application No. PCT/KR2016/009503 (filed on Aug. 26, 2016) under 35 U.S.C. § 371, which claims priority to Korean Patent Application No. 10-2015-0121096 (filed on Aug. 27, 2015), the teachings of which are incorporated herein in their entireties by reference.

TECHNICAL FIELD

The present invention relates generally to a dual pumping fluid pump. More particularly, the present invention relates to a dual pumping fluid pump, with a pair of first and second diaphragms being disposed on a pump housing. In response to rotation of a single electric motor, the first and second diaphragms are alternatingly moved upwards and downwards in the opposite directions, opening or closing first and second intake holes and first and second discharge holes using first and second intake check valves and first and second discharge check valves, provided in a fluid passage box integrally and connectively disposed on the top surface of the pump housing, thereby causing fluid to be introduced through the fluid inlet and to be discharged through the fluid outlet. This can significantly reduce vibration and noise by pressure balancing due to simultaneous actions of a fluid intake pressure and a fluid discharge pressure.

BACKGROUND ART

A fluid pump using a diaphragm is a device for pumping fluid by converting rotational motion of a motor into linear motion of a diaphragm using a device, such as a cam. Such fluid pumps are used generally for injection of fluid in the gaseous or liquid state, due to small variations in the discharge flow rate thereof.

Korean Patent No. 10-0291161 disclosed a hydraulic pump using a diaphragm.

Referring to the disclosure of this patent document, FIGS. 1 and 2 illustrate an example of a related-art hydraulic pump using a diaphragm. A diaphragm 110 is disposed in an opening of a pump head 100 to be fitted into a support ring 120, thereby forming a pump chamber 130. An intake hole 105 and a discharge hole 106 are formed in the bottom and the top of a body 102.

The intake hole 105 and the discharge hole 106 are opened or closed by check balls 140, respectively. Opening-side valve seats 141 in the shape of a cross recess, as illustrated in FIG. 3, are formed in an intake end of the intake hole 105 of the pump head 100 and in one end of a discharge-side connector 160, respectively, and closing-side tapered valve seats 142 are formed in a discharge end of the discharge hole 106 of the pump head 100 and in one end of an intake-side connector 150, respectively.

The operation of the related-art diaphragm pump configured as above will be described briefly as follows.

When a motor (not shown) is started to drive the pump, rotational motion of the motor is converted into reciprocal motion of a diaphragm shaft 111 by a device, such as an eccentric cam, so that the diaphragm 110 is driven to move forwards and backwards.

FIG. 1 illustrates a position in which the diaphragm is driven backwards, i.e. an intake stroke, while FIG. 2 illustrates a position in which the diaphragm is driven forwards, i.e. a discharge stroke.

In the intake stroke, both intake-side and discharge-side check balls 140 are displaced toward the center of the pump head 100, due to negative pressure within the pump chamber. Since the opening-side valve seat 141 is provided in the intake end of the intake hole 105 of the pump head 100, when fluid is taken into the pump chamber 130 along the cross recess, the discharge hole 106 is closed by the check ball.

In the subsequent discharge stroke, both check balls are displaced outwardly from the pump head 100, so that the intake hole 105 is closed while only the discharge hole 106 is opened, thereby allowing fluid to be discharged outwardly from the pump chamber through the cross recess provided in the discharge-side connector 160.

The related-art diaphragm pump as described above has an advantage in that the average amount of discharge is substantially constant, when considered over the long term. However, the pumping is intermittently performed, since this operation is comprised of the intake stroke and the discharge stroke.

As illustrated in FIG. 4, there is a fundamental problem in that pulsation occurs in the flow rate of discharged fluid.

In the related art, to prevent the pulsation from occurring in the flow rate of discharged fluid, a solution of reducing pulsation by connecting two or more pumps in parallel to act on different strokes (see FIG. 5) has been used. As illustrated in FIG. 6, a solution of disposing an air chamber 200 in the middle of a fluid pipe has also been used. The solution illustrated in FIG. 6 reduces the amount of fluid discharged toward a discharge pipe 210 by compressing air within the air chamber 200 during a discharge stroke, and during an intake stroke, discharges fluid, stored in the air chamber 200 during the discharge stroke, toward the discharge pipe 210 due to the expansion force of compressed air. Reference numeral 220 indicates a safety valve configured to be opened when the pressure of fluid has a predetermined level or higher, causing high-pressure fluid to be recovered through a return pipe 230. In addition, reference numeral 201 indicates a pressure meter.

However, the solution of connecting two or pumps in parallel has a problem of excessively increasing construction costs compared to the effects. According to the solution of disposing an air chamber in the middle of a fluid pipe, construction operations based thereon are not easy. In addition, when connectors and fluid paths of the pump are tubular, construction is difficult.

In addition, connecting portions are frequently broken due to the vibration of an air chamber during the operation of the pump. Since pulsation in the discharge flow rate of the pump is not fundamentally removed, significant vibration and noise are still generated.

DISCLOSURE

Technical Problem

Accordingly, the present invention has been made keeping in mind the above problems occurring in the prior art, and an object of the present invention is to provide a dual pumping fluid pump having a higher quality superior to that of a related-art fluid pump. In the dual pumping fluid pump, first and second diaphragms connectively disposed on a pump housing are alternatingly moved upwards and downwards in the opposite directions, in response to rotation of a single electric motor, causing first and second intake holes and first and second discharge holes to be opened or closed using first and second intake check valves and first and second discharge check valves provided in a fluid passage box connectively disposed on the top surface of the pump housing, so that fluid introduced through the fluid inlet is discharged through the fluid outlet. Consequently, pressure balancing due to simultaneous actions of the fluid intake pressure and the fluid discharge pressure can reduce vibration and noise to the maximum extent.

In addition, a pulsation preventing means is additionally provided in the fluid passage box including the fluid intake check valves and the fluid discharge check valves. When a fluid discharge pressure or a fluid intake pressure is formed, a lower pad of the pulsation preventing means is elastically deformed upwards and downwards, thereby more effectively preventing pulsation. When a variety of products are provided with the dual pumping fluid pump, the products can be used quietly and conveniently.

Technical Solution

In order to accomplish the above object, the present invention provides a fluid pumping dual pump, in which a cam is axially disposed on a rotary shaft of a single electric motor, with eccentric shaft portions thereof being positioned in opposite directions.

A pair of first and second diaphragms disposed in a pump housing, bottom portions of the first and second diaphragms being connectively disposed on the eccentric shaft portions of the cam, such that the first and second diaphragms are movable upwards and downwards in response to the cam being rotated.

When the single electric motor is started, the first and second diaphragms enable pumping by alternatingly moving up and down. This opens or closes the first and second intake holes and the first and second discharge holes using the first and second intake valves and the first and second discharge valves disposed in the fluid passage box connectively disposed on the top surface of the pump housing, so that fluid is introduced through a fluid inlet while being discharged through a fluid outlet. Thus, this configuration can reduce vibration and noise to the maximum extent, due to pressure balancing, i.e. simultaneous actions of a fluid intake pressure and fluid discharge pressure.

Advantageous Effects

In the dual pumping fluid pump according to the present invention, when the cam axially disposed on the rotary shaft of the single electric motor is rotated, the first and second diaphragms connectively disposed on the eccentric shaft portions on the left and right portions of the cam are alternatingly moved upwards and downwards in the opposite directions, causing the first and second intake holes and the first and second discharge holes to be opened or closed using the first and second intake check valves and the first and second discharge check valves provided in the fluid passage box connectively disposed on the top surface of the pump housing, so that fluid introduced through the fluid inlet is discharged through the fluid outlet. Consequently, pressure balancing due to simultaneous actions of the fluid intake pressure and the fluid discharge pressure can significantly reduce vibration and noise.

In addition, according to the present invention, the recessed spaces are further formed in the bottom surface of the upper cap, in locations corresponding to the corresponding to the intake check valve receptacle and the discharge check valve receptacle. Thus, when a fluid intake pressure and a fluid discharge pressure are formed in the intake check valve receptacle and the discharge check valve receptacle, the lower pad is elastically deformed upwards and downwards for pressure balancing, thereby more effectively preventing fluid pulsation.

Accordingly, when a variety of products provided with the dual pumping fluid pump according to the present invention are used, the products can be used quietly and conveniently for a long time without malfunction, since there are substantially no noise and vibration.

BEST MODE

Figure 1:
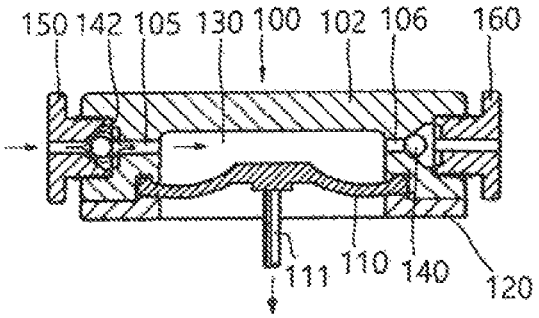
FIGS. 1 and 2 are main portion cross-sectional views illustrating the structure and operation of a fluid pump using a diaphragm of the related art.
Figure 2:
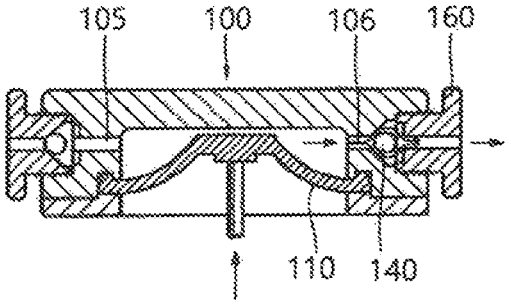
Figure 3:
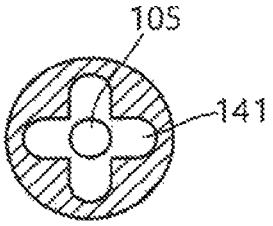
FIG. 3 is a top view of an opening-side valve seat in the shape of a cross.
Figure 4:
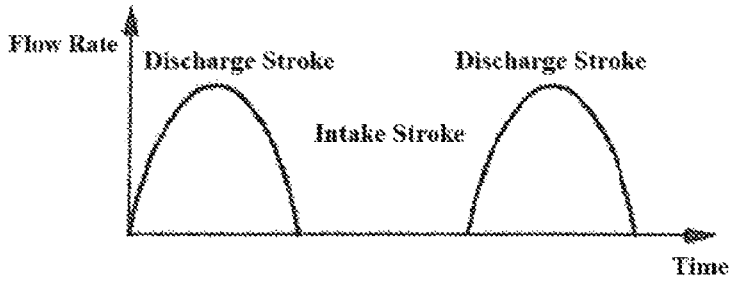
FIGS. 4 and 5 are graphs illustrating flow rate pulsation occurring in discharged fluid and a flow rate profile of fluid discharged when the flow rate pulsation is reduced.
Figure 5:
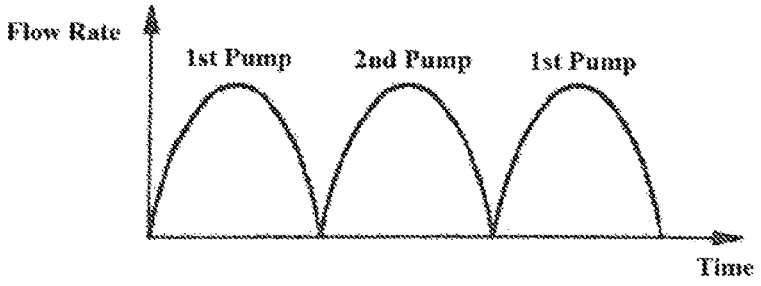
Figure 6:
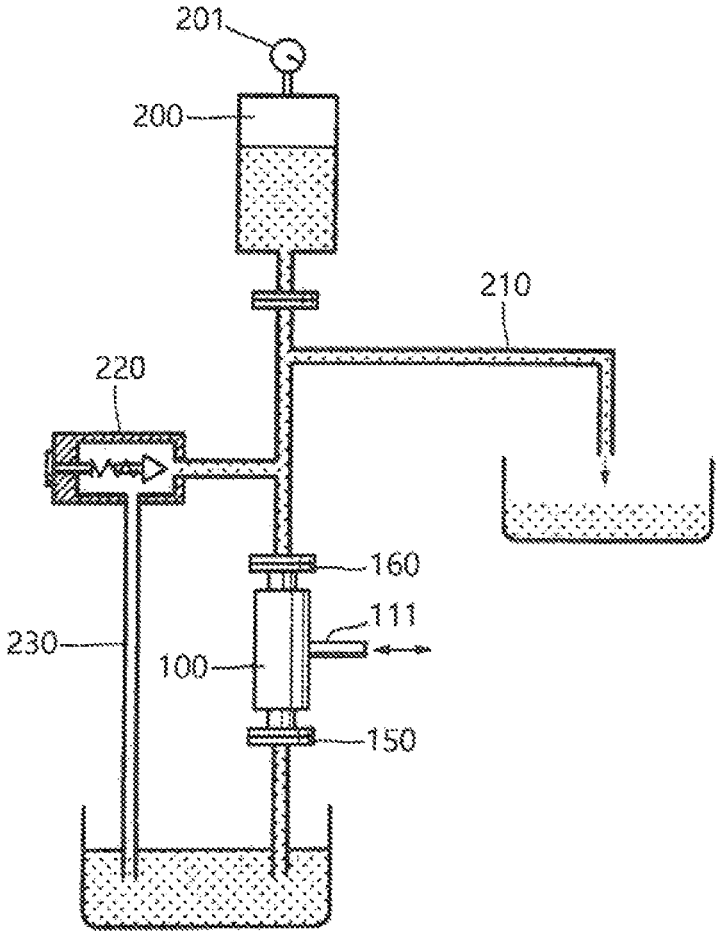
FIG. 6 is a schematic view illustrating an example in which an air chamber and a safety valve are disposed in the middle of a fluid pipe.

Hereinafter, exemplary embodiments of the present invention will be described in detail with reference to the accompanying drawings. Embodiments disclosed hereinafter are only provided for illustrative purposes. It should be understood that the present invention is not limited to the following embodiments and may be embodied in a variety of different forms. In the following description of the present invention, detailed descriptions of known functions and components incorporated herein will be omitted in the case that the subject matter of the present invention may be rendered unclear thereby. In the drawings, the size and thickness of the device may be exaggerated for the sake of clarity.

Figure 7:
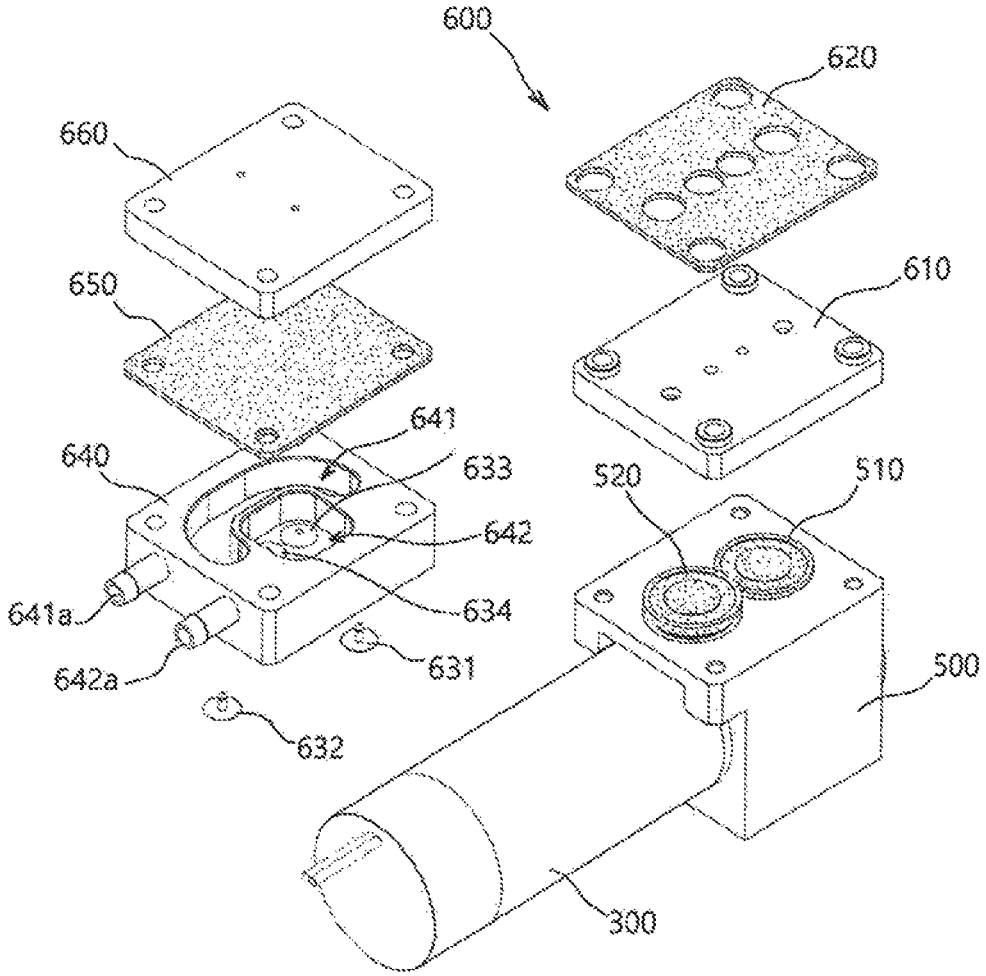
FIG. 7 is an exploded perspective view of the entire portions of the dual pumping fluid pump.
Figure 8:
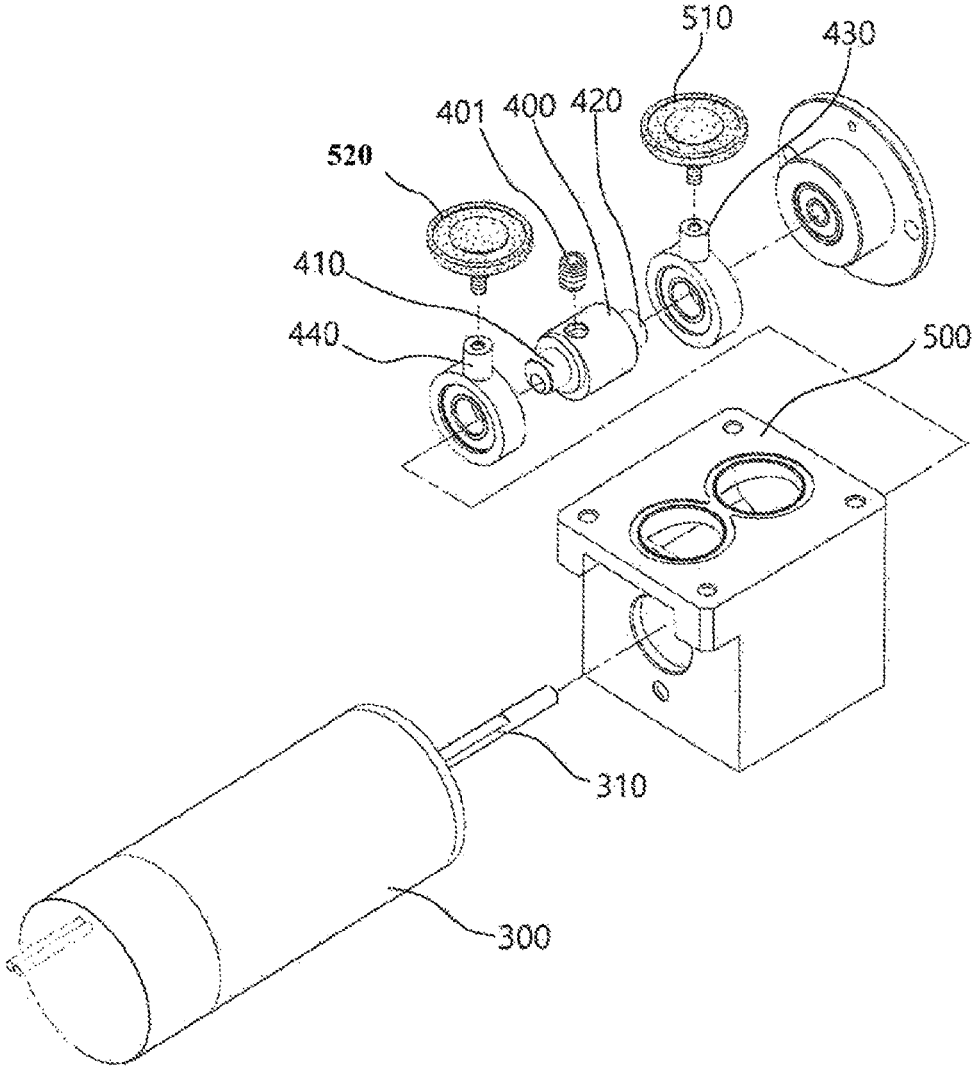
FIG. 8 is an exploded perspective view of portions of the dual pumping fluid pump, illustrating the connection of the diaphragm.
Figure 9:
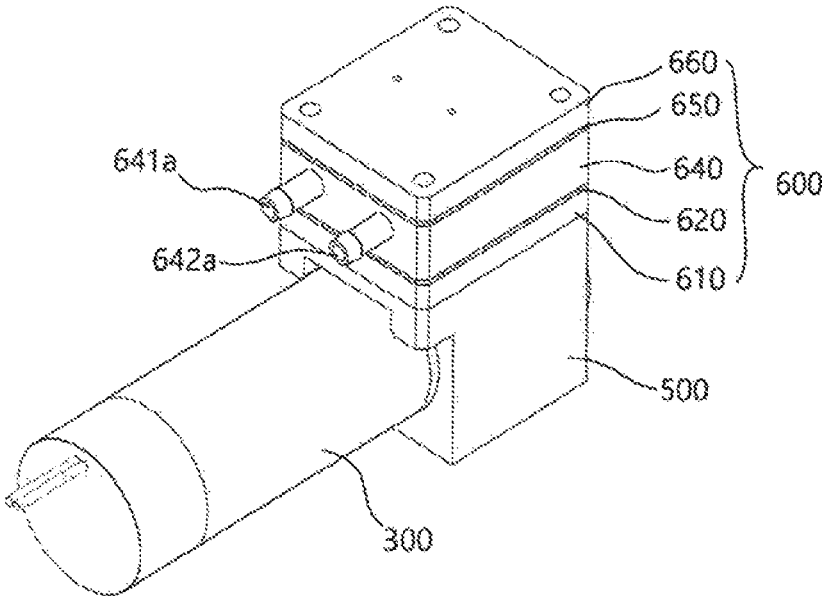
FIG. 9 is an assembly view of the entire portions of the dual pumping fluid pump.
Figure 10:
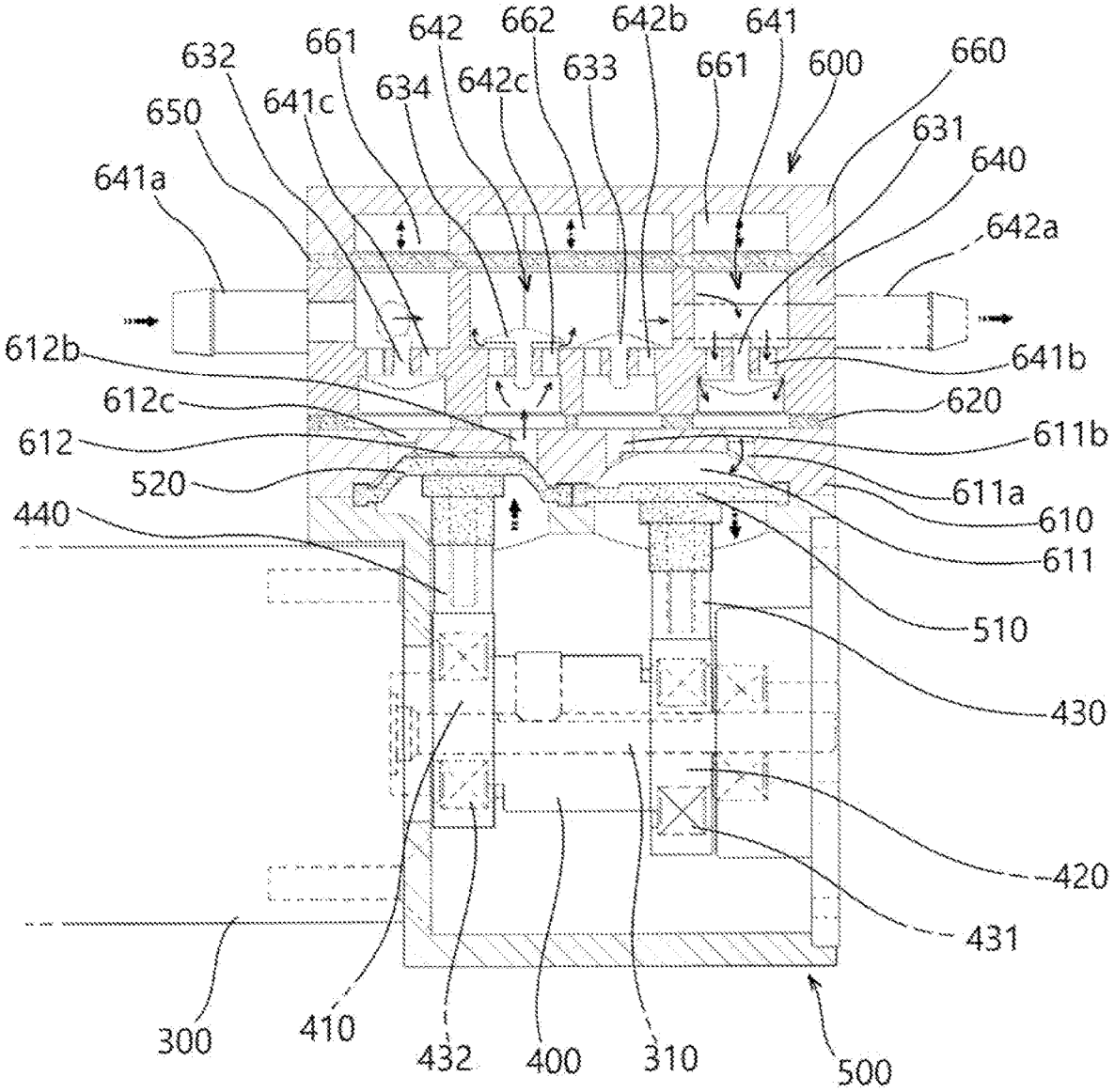
FIG. 10 is a side cross-sectional view of the assembled dual pumping fluid pump, illustrating the operating state thereof.

A dual pumping fluid pump according to the present invention is illustrated in FIGS. 7 to 10.

A single electric motor 300 is coupled to one side of a pump housing 500, such that a rotary shaft 310 of the electric motor 300 is disposed within the pump housing.

In addition, a cam 400 is axially mounted on the rotary shaft 310 using a fixing means, such as a bolt 401. Eccentric shaft portions 410 and 420 are provided on left and right portions of the cam 400, extending in opposite directions.

In addition, a pair of diaphragms, i.e. first and second diaphragms 510 and 520, are disposed in the pump housing 500. Bottom portions of the first and second diaphragms 510 and 520 are connected to the eccentric shaft portions 410 and 420 of the cam 400, such that the first and second diaphragms 510 and 520 are moved up and down by the rotation of the cam 400.

A fluid passage box 600 is connectively disposed on the top surface of the pump housing 500 in which the first and second diaphragms 510 and 520 are disposed. The fluid passage box 600 includes first and second intake check valves 631 and 632 opening and closing first and second intake holes 641*b* and 641*c* and first and second discharge check valves 633 and 634 opening and closing first and second discharge holes 642*b* and 642*c*. When the single electric motor 300 is started, the first and second diaphragms 510 and 520 enable pumping by alternatingly moving up and down. This opens or closes the first and second intake holes 641*b* and 641*c* and the first and second discharge holes 642*b* and 642*c* using the first and second intake valves 631 and 632 and the first and second discharge valves 633 and 634 disposed in the fluid passage box 600 connectively disposed on the top surface of the pump housing 500, so that fluid is introduced through a fluid inlet 641*a* while being discharged through a fluid outlet 642*a*. Thus, this configuration can reduce vibration and noise to the maximum extent, due to pressure balancing, i.e. simultaneous actions of a fluid intake pressure and fluid discharge pressure.

Here, according to the present invention, when the first and second diaphragms 510 and 520, disposed in the pump housing 500, are connected to the eccentric shaft portions 410 and 420 of the cam 400, upwardly-and-downwardly movable arms 430 and 440 are axially disposed on the eccentric shaft portions 410 and 420 of the cam 400, respectively.

The top ends of the upwardly-and-downwardly movable arms 430 and 440 are connected to the first and second diaphragms, respectively, by bolt fastening.

In addition, the fluid passage box 600, connectively disposed on the top surface of the pump housing 500, includes a lower body 610, an upper body 640, an upper cap 660, a lower pad 620, and an upper pad 650.

The lower body 610 is connectively disposed on the top surface of the pump housing 500. The lower body 610 includes a first pump chamber 611 having a first intake path 611*a* and a first discharge path 611*b* formed in the bottom thereof and a second pump chamber 612 having a second intake path 612*c* and a second discharge path 612*b* formed therein.

The upper body 640 is connectively disposed above the lower body 610. The upper body 640 includes an intake check valve receptacle 641 having a fluid inlet 641*a*, with the first and second intake check valves 631 and 632 being disposed in the intake check valve receptacle 641 to open and close the first and second intake holes 641*b* and 641*c*, and a discharge check valve receptacle 642 having a fluid outlet 642*a*, with the discharge check valves 633 and 634 being disposed in the discharge check valve receptacle 642 to open and close the first and second intake holes 641*b* and 641*c*.

The upper cap 660 is connectively disposed above the upper body 640 to tightly seal the top portion of the upper body 640.

The lower pad 620 is interposed between the lower body 610 and the upper body 640 to provide a hermetic seal preventing fluid from leaking while causing fluid taken in and discharged to be separately supplied to the intake check valve receptacle 641 and the discharge check valve receptacle 642.

The upper pad 650 is interposed between the upper body 640 and the upper cap 660 to provide a hermetic seal preventing fluid from leaking while preventing fluid taken in and discharged from mixing between the intake check valve receptacle 641 and the discharge check valve receptacle 642.

In addition, according to the present invention, recessed spaces 661 and 662 are further formed in the bottom surface of the upper cap 660, in locations corresponding to the intake check valve receptacle 641 and the discharge check valve receptacle 642. When fluid discharge pressure and fluid intake pressure are formed in the intake check valve receptacle 641 and the discharge check valve receptacle 642, the upper pad 650 is elastically deformed upwards and downwards for pressure balancing, thereby more effectively preventing pressure pulsation.

Hereinafter, the state of use of the dual pumping fluid pump according to the present invention, having the above-described configuration, will be described.

First, when the single electric motor 300 is started, the rotary shaft 310 rotates, causing the cam 400 axially disposed on the rotary shaft 310 to rotate.

Since the eccentric shaft portions 410 and 420 are provided in opposite directions on both sides of the cam 400, the upwardly-and-downwardly movable arms 430 and 440 are axially disposed on the eccentric shaft portions 410 and 420 via bearings 431 and 432, respectively, and the upwardly-and-downwardly movable arms 430 and 440 are connected to the bottom ends of the first and second diaphragms 510 and 520, respectively, when an intake pressure is formed in the first pump chamber 611 in response to the first diaphragm 510 moving downwards, the first intake check valve 631 disposed on the bottom surface of the intake check valve receptacle 641 is opened, causing fluid introduced through the fluid inlet 641*a* from an external source to be taken into the first pump chamber 611 through the first intake hole 641*b* and the first intake path 611*a*.

At the same time, when a discharge pressure is formed in the second pump chamber 612 in response to the second diaphragm 520 moving upwards, fluid is supplied through the second discharge path 612*b*, causing the second discharge check valve 634 to be opened, so that fluid is fed under pressure to the discharge check valve receptacle 642 and is discharged outwards through the fluid outlet 642*a* of the discharge check valve receptacle 642.

Afterwards, the cam 400 continues to rotate. At this time, contrary to the above, when a discharge pressure is formed in the first pump chamber 611 in response to the first diaphragm 510 moving upwards from the downwardly-moved position, fluid is supplied through the first discharge path 611*b* to open the first discharge check valve 633, so that fluid is fed under pressure from the first pump chamber 611 to the discharge check valve receptacle 642 through the first discharge hole 642*b* and is discharged outwards through the fluid outlet 642*a* of the discharge check valve receptacle 642.

At the same time, when an intake pressure is formed in the second pump chamber 612 in response to the second diaphragm 520 moving downwards from the upwardly-moved position, the second intake check valve 632 disposed on the bottom surface of the intake check valve receptacle 641 is opened, so that fluid introduced through the fluid inlet 641*a* from an external source is taken into the second chamber 612 through the second intake hole 641*c* and the second intake path 612*a*.

As set forth above, in the dual pumping fluid pump according to the present invention, when the cam 400 axially disposed on the rotary shaft 310 of the single electric motor 300 is rotated, the first and second diaphragms 510 and 520 connectively disposed on the eccentric shaft portions 410 and 420 on the left and right portions of the cam 400 are alternatingly moved upwards and downwards in the opposite directions, causing the first and second intake holes 641*b* and 641*c* and the first and second discharge holes 642*b* and 642*c* to be opened or closed using the first and second intake check valves 631 and 632 and the first and second discharge check valves 633 and 634 of the fluid passage box 600 connectively disposed on the top surface of the pump housing 500, so that fluid introduced through the fluid inlet 641*a* is discharged through the fluid outlet 642*a*. Consequently, pressure balancing due to simultaneous actions of the fluid intake pressure and the fluid discharge pressure can reduce vibration and noise to the maximum extent.

Furthermore, according to the present invention, the recessed spaces 661 and 662 are further formed in the bottom surface of the upper cap 660, in locations corresponding to the corresponding to the intake check valve receptacle 641 and the discharge check valve receptacle 642. Thus, when a fluid intake pressure and a fluid discharge pressure are formed in the intake check valve receptacle 641 and the discharge check valve receptacle 642, the lower pad 620 is elastically deformed upwards and downwards for pressure balancing, so that fluid pulsation can be more effectively prevented.

Accordingly, when a variety of products provided with the dual pumping fluid pump according to the present invention are used, the products can be used quietly and conveniently for a long time without malfunction, since there are substantially no noise and vibration.

Although the present invention has been described with reference to the specific embodiments and the drawings, the present invention is by no means limited to the foregoing embodiments. Those skilled in the art will appreciate that various modifications and variations are possible, without departing from the scope and spirit of the present invention as disclosed in the accompanying claims.

INDUSTRIAL APPLICABILITY

In the dual pumping fluid pump according to the present invention, when the cam axially disposed on the rotary shaft of the single electric motor is rotated, the pair of first and second diaphragms connectively disposed on the eccentric shaft portions on the left and right portions of the cam are alternatingly moved upwards and downwards in the opposite directions, opening or closing the first and second intake holes and the first and second discharge holes using the first and second intake check valves and the first and second discharge check valves in the fluid passage box integrally and connectively disposed on the top surface of the pump housing, thereby causing fluid to be introduced through the fluid inlet and to be discharged through the fluid outlet. Consequently, pressure balancing due to simultaneous actions of a fluid intake pressure and a fluid discharge pressure can significantly reduce vibration and noise.

In addition, according to the invention, the recessed spaces are further provided in the bottom surface of the upper cap, in locations corresponding to the discharge check valve receptacle and the intake check valve receptacle. When a fluid discharge pressure and a fluid intake pressure are formed in the discharge check valve receptacle and the intake check valve receptacle, the lower pad can be elastically deformed upwards and downwards for pressure balancing, thereby more effectively preventing pulsation.

Accordingly, when a variety of products provided with the dual pumping fluid pump according to the present invention are used, the products can be used quietly and conveniently for a long time without malfunction, since there are substantially no noise and vibration. In particular, the dual pumping fluid pump according to the present invention can be widely used in home oxygen water generators or home hydrogen water generators.

The invention claimed is:

1. A fluid pumping dual pump comprising:

a pump housing having a first opening and a second opening at a top portion thereof;

a motor coupled to the pump housing;

a cam disposed in the pump housing and axially mounted on a rotary shaft of the motor;

a first eccentric shaft portion and a second eccentric shaft portion respectively connected on opposite sides of the cam;

a first upwardly-and-downwardly movable arm and a second upwardly-and-downwardly movable arm respectively connected to the first eccentric shaft portion and the second eccentric shaft portion; and a first diaphragm and a second diaphragm respectively disposed on and to cover the first and second openings of the pump housing, wherein a bottom portion of the first diaphragm is connected to the first upwardly-and-downwardly movable arm and a bottom portion of the second diaphragm is connected to the second upwardly-and-downwardly movable arm, such that the first and second diaphragms are movable upwards and downwards in response to the rotation of the cam, wherein, when the motor is started, the first and second diaphragms are alternatingly moved up and down in response to the rotation of the cam, thereby causing fluid to be introduced through a fluid inlet while being discharged through a fluid outlet by opening or closing first and second intake holes and first and second discharge holes using first and second intake valves and first and second discharge valves, respectively, wherein the first intake hole, the first discharge hole, and the first discharge valve are disposed above the first diaphragm, wherein the second intake hole, the second discharge hole, and the second discharge valve are disposed above the second diaphragm, wherein the first and second intake holes, the first and second discharge holes, the first and second discharge valves are disposed in a fluid passage box, the fluid passage box being integral and connectively disposed on a top surface of the pump housing, and wherein the fluid passage box comprises:

a lower body connectively disposed on the top surface of the pump housing, wherein a first pump chamber having a first intake path and a first discharge path and a second pump chamber having a second intake path and a second discharge path are formed in the lower body;

an upper body connectively disposed above the lower body, the upper body comprising an intake check valve receptacle having the fluid inlet with the first and second intake valves being disposed in the intake check valve receptacle to open and close the first and second intake holes, and a discharge check valve receptacle having the fluid outlet, with the first and second discharge valves being disposed in the discharge check valve receptacle to open and close the first and second discharge holes;

an upper cap connectively disposed above the upper body to tightly seal a top portion of the upper body;

a lower pad interposed between the lower body and the upper body to provide a hermetic seal preventing fluid from leaking while causing fluid taken in and discharged to be separately supplied to the intake check valve receptacle and the discharge check valve receptacle; and an upper pad interposed between the upper body and the upper cap to provide a hermetic seal preventing fluid from leaking while preventing fluid taken in and discharged from mixing between the intake check valve receptacle and the discharge check valve receptacle.

2. The fluid pumping dual pump according to claim 1, wherein recessed spaces are further provided in a bottom surface of the upper cap, in locations corresponding to the intake check valve receptacle and the discharge check valve receptacle, such that, when a fluid discharge pressure and fluid intake pressure are formed in the intake check valve receptacle and the discharge check valve receptacle, the upper pad is elastically deformed upwards and downwards for pressure balancing.

3. The fluid pumping dual pump according to claim 1, wherein the motor is a single electric motor.

* * * * *